US008013687B2

(12) United States Patent
Espino et al.

(10) Patent No.: US 8,013,687 B2
(45) Date of Patent: Sep. 6, 2011

(54) ORTHO-MODE TRANSDUCER WITH TEM PROBE FOR COAXIAL WAVEGUIDE

(75) Inventors: Cynthia P. Espino, Carlsbad, CA (US); John P. Mahon, Thousand Oaks, CA (US)

(73) Assignee: Optim Microwave, Inc., Camarillo, CA (US)

( * ) Notice: Subject to any disclaimer, the term of this patent is extended or adjusted under 35 U.S.C. 154(b) by 0 days.

(21) Appl. No.: 12/911,672

(22) Filed: Oct. 25, 2010

(65) Prior Publication Data

US 2011/0037534 A1 Feb. 17, 2011

Related U.S. Application Data

(63) Continuation-in-part of application No. 12/098,310, filed on Apr. 4, 2008, now Pat. No. 7,821,356.

(51) Int. Cl.
*H01P 1/161* (2006.01)
*H01P 5/12* (2006.01)

(52) U.S. Cl. ..... 333/125; 333/21 A; 333/21 R; 333/135; 333/137; 333/251

(58) Field of Classification Search ..... 333/21 A, 333/21 R, 125, 135, 137, 251
See application file for complete search history.

(56) References Cited

U.S. PATENT DOCUMENTS

| | | | | |
|---|---|---|---|---|
| 3,922,621 | A | 11/1975 | Gruner | |
| 4,158,183 | A * | 6/1979 | Wong et al. | 333/21 A |
| 4,558,290 | A | 12/1985 | Lee | |
| 5,212,461 | A * | 5/1993 | Aicardi et al. | 333/125 |
| 6,031,434 | A | 2/2000 | Tatomir | |
| 6,211,750 | B1 * | 4/2001 | Gould | 333/21 A |
| 6,323,819 | B1 | 11/2001 | Ergene | |
| 6,657,516 | B1 | 12/2003 | Junker | |
| 6,661,309 | B2 | 12/2003 | Chen | |
| 6,714,165 | B2 | 3/2004 | Verstraeten | |
| 6,724,277 | B2 | 4/2004 | Holden | |

* cited by examiner

*Primary Examiner* — Robert Pascal
*Assistant Examiner* — Kimberly Glenn
(74) *Attorney, Agent, or Firm* — SoCal IP Law Group LLP; Mark A. Goldstein; John E. Gunther

(57) ABSTRACT

An ortho-mode transducer may include an annular common waveguide defined by an outside surface of an inner conductor and an inside surface of an outer conductor, the outside surface and the inside surface concentric about a waveguide axis. A first port may couple a first $TE_{11}$ mode to the annular common waveguide. A second port may couple a second $TE_{11}$ mode to the annular common waveguide, the second $TE_{11}$ mode orthogonal to the first $TE_{11}$ mode. A TEM probe may suppress resonance of a TEM mode within the annular common waveguide.

15 Claims, 10 Drawing Sheets

Section A-A

Section B-B

Section A-A

ORTHO-MODE TRANSDUCER WITH TEM PROBE FOR COAXIAL WAVEGUIDE

RELATED APPLICATION INFORMATION

This patent is a continuation in part of application Ser. No. 12/098,310, filed Apr. 4, 2008, entitled Ortho-Mode Transducer For Coaxial Waveguide, now U.S. Pat. No. 7,821,356, the entire disclosure of which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to ortho-mode transducers for coupling orthogonally polarized $TE_{11}$ modes into or from coaxial waveguides.

2. Description of the Related Art

Satellite broadcasting and communications systems commonly use separate frequency bands for the uplink to and downlink from satellites. Additionally, one or both of the uplink and downlink typically transmit orthogonal right-hand and left-hand circularly polarized signals within the respective frequency band.

Typical antennas for transmitting and receiving signals from satellites consist of a parabolic dish reflector and a coaxial feed where the high frequency band signals travel through a central circular waveguide and the low frequency band signals travel through an annular waveguide coaxial with the high-band waveguide. Note that the terms "circular" and "annular" refer to the cross-sectional shape of each waveguide. An ortho-mode transducer may be used to launch or extract orthogonal $TE_{11}$ linear polarized modes into the high-band and low-band coaxial waveguides. A linear polarization to circular polarization converter is commonly disposed within each of the high-band and low-band coaxial waveguides to convert the orthogonal $TE_{11}$ modes into left-hand and right-hand circular polarized modes for communication with the satellite.

An ortho-mode transducer (OMT) is a three-port waveguide device having a common waveguide coupled to two branching waveguides. Within this description, the term "port" refers generally to an interface between devices or between a device and free space. A port may include an interfacial surface, an aperture in the interfacial surface to allow microwave radiation to enter or exit a device, and provisions to mount or attach an adjacent device.

The common waveguide of an OMT typically supports two orthogonal linearly polarized modes. Within this document, the terms "support" and "supporting" mean that a waveguide will allow propagation of a mode with little or no loss. In a feed system for a satellite antenna, the common waveguide may be a circular waveguide or an annular waveguide. The two orthogonal linearly polarized modes may be $TE_{11}$ modes which have an electric field component orthogonal to the axis of the common waveguide. Two precisely orthogonal $TE_{11}$ modes do not interact or cross-couple, and can therefore be used to communicate different information.

The common waveguide terminates at a common port aperture. The common port aperture is defined by the intersection of the common waveguide and an exterior surface of the OMT.

Each of the two branching waveguides of an OMT typically supports only a single linearly polarized mode. The mode supported by the first branching waveguide is orthogonal to the mode supported by the second branching waveguide. Within this document, the term "orthogonal" will be used to describe the polarization direction of modes, and "normal" will be used to describe geometrically perpendicular structures.

The two branching ports and the associated waveguides are commonly termed the "vertical" and "horizontal" ports. The terms "horizontal" and "vertical" will be used in this document to denote the two orthogonal modes and the waveguides and ports supporting those modes. Note, however, that these terms do not connote any particular orientation of the modes or waveguides with respect to the actual physical horizontal and vertical directions.

In order to minimize coupling between orthogonal $TE_{11}$ modes, the OMT that launches the $TE_{11}$ modes must provide high isolation between the orthogonal $TE_{11}$ modes, and must avoid launching or coupling the TEM (transverse electromagnetic) mode and higher order modes.

Throughout this description, elements appearing in views of the OMT are assigned three-digit reference designators, where the most significant digit is the figure number where the element was first introduced and the two least significant digits are specific to the element. An element that is not described in conjunction with a figure may be presumed to have the same characteristics and function as a previously-described element having the same reference designator.

DETAILED DESCRIPTION

Description of Apparatus

Figure 1:
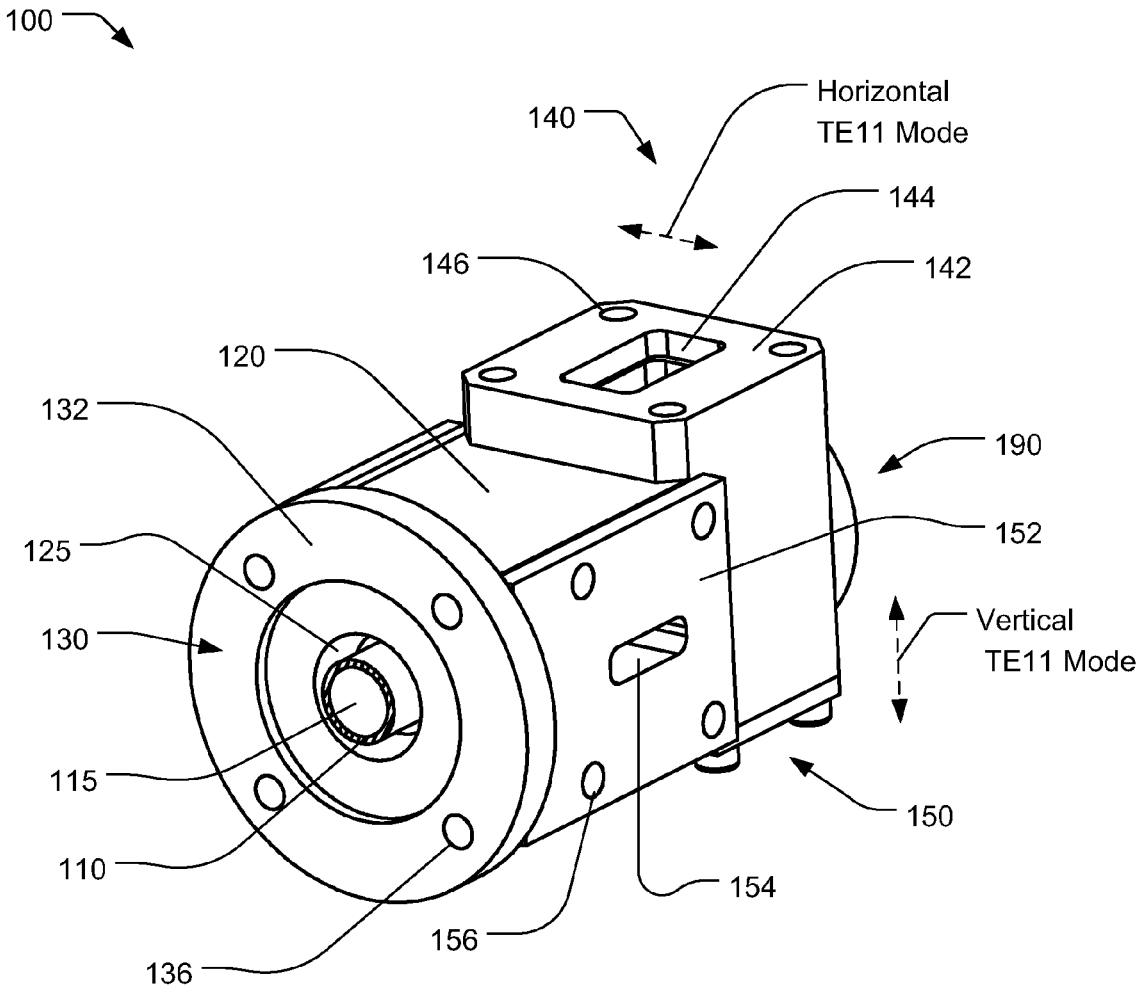
FIG. 1 is a perspective view of an exemplary OMT for a coaxial waveguide.

Referring now to FIG. 1, an exemplary OMT 100 may include an inner conductor 110 and an outer conductor 120. The outer conductor 120 may also function as the body of the OMT 100. A generally cylindrical opening in the inner conductor 110 may define a circular waveguide 115. A space between the inner conductor 110 and the outer conductor 120 may define an annular waveguide 125, which may be coaxial with the circular waveguide 115. The annular waveguide 125 may be the common waveguide of the OMT 100.

The circular waveguide 115 and the annular waveguide 125 may terminate at a common port 130. The common port 130 may be defined by the intersection of the annular waveguide 125 and a common port flange 132. The common port flange may be provided with tapped or thru mounting holes 136. Both the cylindrical waveguide 115 and the annular waveguide 125 may be coupled to other waveguide components (not shown) that may be bolted via the mounting holes 136, or otherwise coupled to the common port flange 132.

A horizontal port 140 may be adapted to couple a horizontal $TE_{11}$ mode to the annular waveguide 125. The horizontal port 140 may be defined by the intersection of a horizontal waveguide 144 and a horizontal port face 142. The horizontal waveguide 144 may have a generally rectangular cross-sectional shape. As shown by the dashed arrow, the electric field vector of the horizontal $TE_{11}$ mode may be aligned with the shorter dimension of the horizontal waveguide 144. Tapped holes 146 may be provided in the horizontal port face 142 to allow attachment of additional waveguide components (not shown).

A vertical port 150 may be adapted to couple a vertical $TE_{11}$ mode to the annular waveguide 125. The vertical port 150 may be defined by the intersection of a vertical waveguide 154 and a vertical port face 152. The vertical waveguide 154 may have a generally rectangular cross-sectional shape. As shown by the dashed arrow, the electric field vector of the vertical $TE_{11}$ mode may be aligned with the shorter dimension of the vertical waveguide 154. Tapped holes 156 may be provided in the vertical port face 152 to allow attachment of additional waveguide components (not shown).

The horizontal port 140 and the vertical port 150 may be disposed on the OMT such that the horizontal $TE_{11}$ mode and the vertical $TE_{11}$ mode are orthogonal. To this end, the plane of the horizontal port face 142 may be normal to the plane of the vertical port face 152. Further, the axis of the horizontal rectangular waveguide 144 and the axis of the vertical rectangular waveguide 154 may be normal.

The circular waveguide 115 may terminate at the common port 130 at one end, and at a circular port 190 (not visible in FIG. 1) at the other end.

FIGS. 2, 3B, 4B, 5, and 6 include dimensions defining a specific embodiment of the OMT 100. The specific embodiment is intended for use in a frequency band from 19.4 GHz to 21.2 GHz, and was designed to satisfy a specific set of requirements. These dimensions are provided as representative example of an OMT. Other embodiments of the OMT 100 intended for use in other frequency bands and for other applications may have significantly different dimensions.

Figure 2:
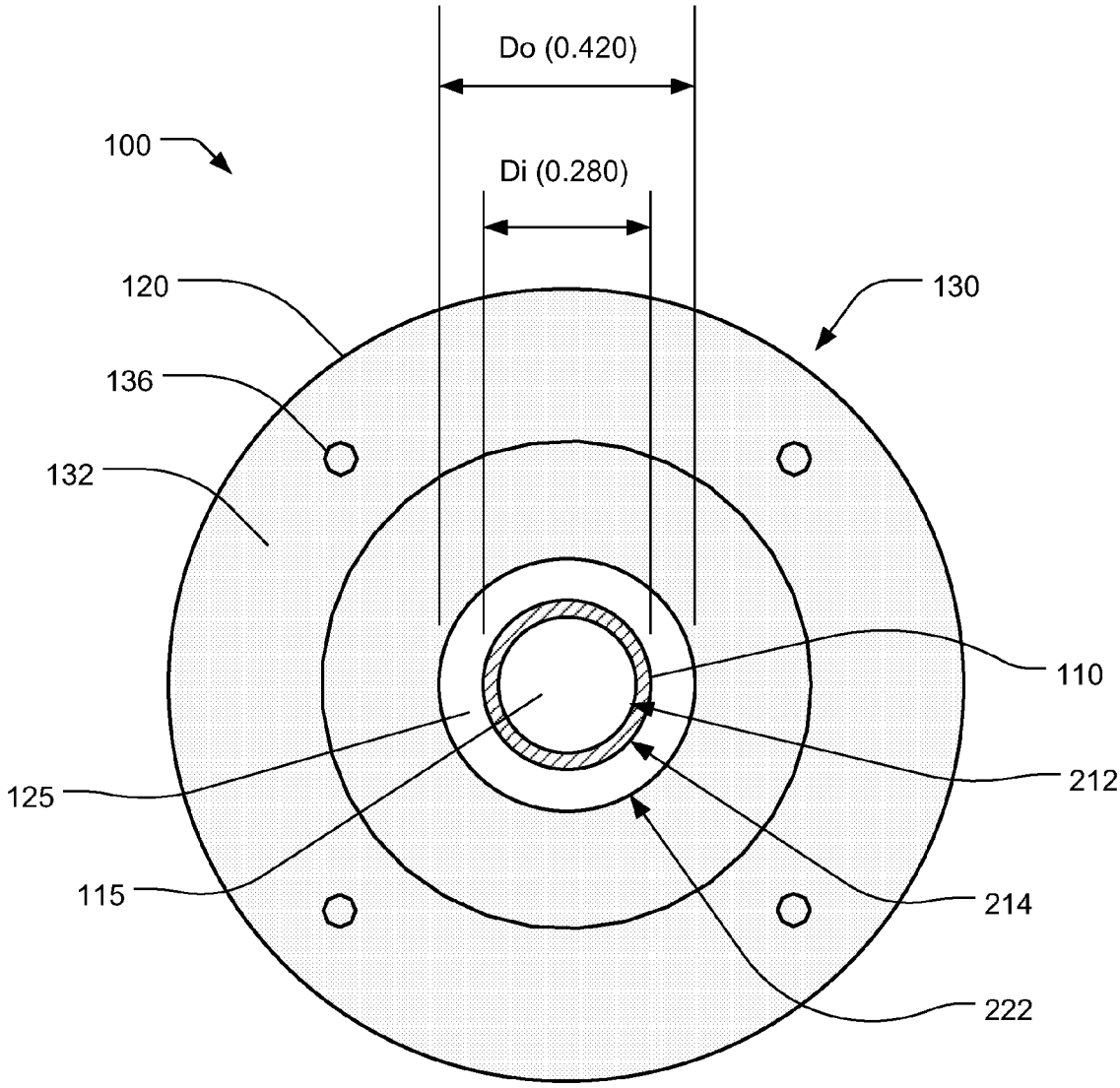
FIG. 2 is an end view of the exemplary OMT.

FIG. 2 is an end view of the exemplary OMT 100 normal to the plane of the common port 130. For clarity, certain internal features of the OMT, visible through the annular waveguide 125, are not shown. The OMT 100 may include an inner conductor 110 and an outer conductor/body 120. The inner conductor 110 may have an inner surface 212 and an outer surface 214. The inner surface 212 of the inner conductor 110 may define and bound the circular waveguide 115. The outer conductor 120 may have an inner surface 222. The surfaces 212, 214, and 222 may be generally cylindrical and coaxial. The outer surface 214 of the inner conductor 110 and the inner surface 222 of the outer conductor 120 may define and bound the annular waveguide 125.

The annular waveguide 125 may have an inner diameter Di, as defined by the surface 214, and an outer diameter Do, as defined by the surface 222. In the specific embodiment of the OMT 100, Di may be 0.280 inches and Do may be 0.420.

Figure 3A:
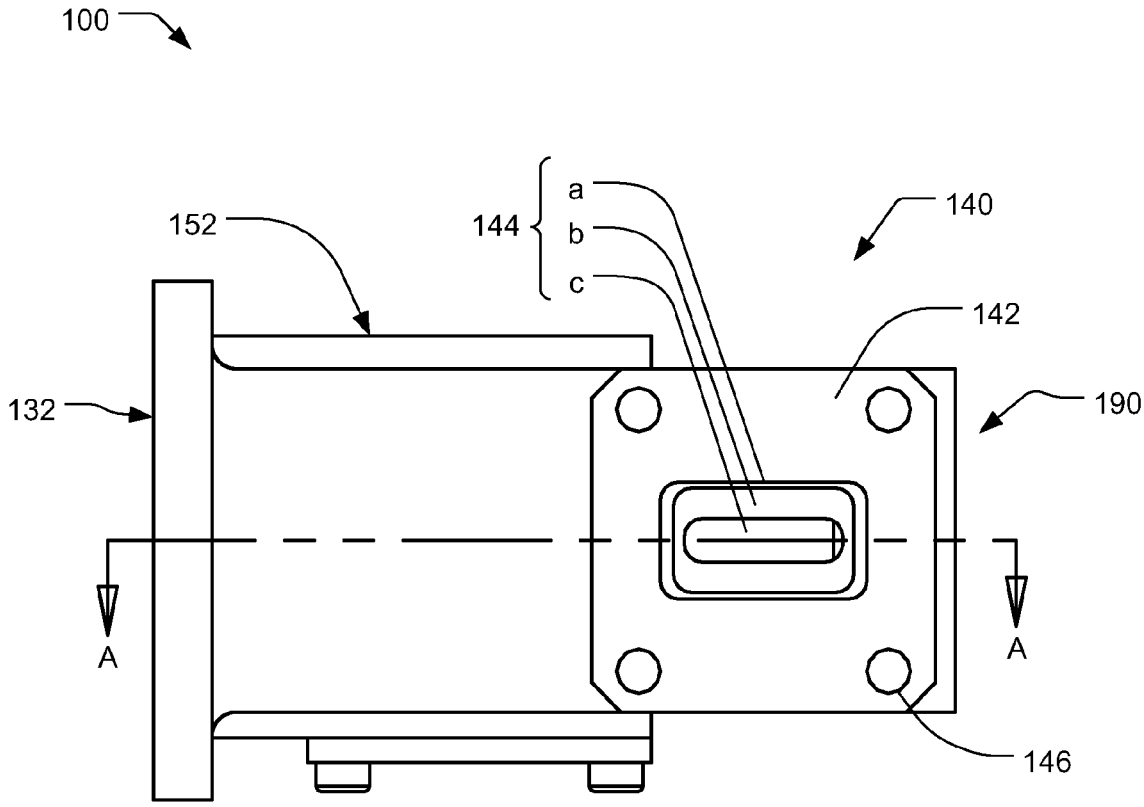
FIG. 3A is a side view of the exemplary OMT.

FIG. 3A is side view of the exemplary OMT 100 normal to the plane of the horizontal port face 142. Looking into the horizontal waveguide 144, three segments a, b, c having differing cross-sectional areas can be seen. Segment a, having the largest cross sectional area, opens to the horizontal port face 142. Segment c, having the smallest cross-sectional area, opens to the annular waveguide 125 (not visible). The section line A-A defines a plane containing the axis of the annular waveguide 125 and the axis of the horizontal waveguide 144. A cross-sectional view of this plane will be shown in FIG. 5.

The three segments a, b, c of the horizontal waveguide 144 may function as matching sections to couple the horizontally polarized $TE_{11}$ mode from the annular waveguide 125 (not visible), while simultaneously rejecting the vertically polarized $TE_{11}$ mode. The term "rejecting" as used in this document means that the vertically polarized mode is cut-off in the horizontal waveguide 144 such that power is not transferred from the annular waveguide to the horizontal port 140.

The cross-sectional shapes and lengths of the three segments a, b, c of the horizontal waveguide may be designed to minimize the return loss for a horizontally polarized $TE_{10}$ mode introduced via a standard waveguide (not shown) attached to the horizontal port face 142. The cross-sectional shape of segment a of the horizontal waveguide 144 may define a horizontal port aperture in the horizontal port face 142. The cross-sectional shape of the horizontal port aperture may be different from, and not coaxial with, the cross-sectional shape of the standard waveguide (not shown) to be attached to the horizontal port face 142. The transition from the cross-sectional shape of the horizontal port aperture and the cross-sectional shape of the attached standard waveguide may contribute to the matching function described in the prior paragraph.

Figure 3B:
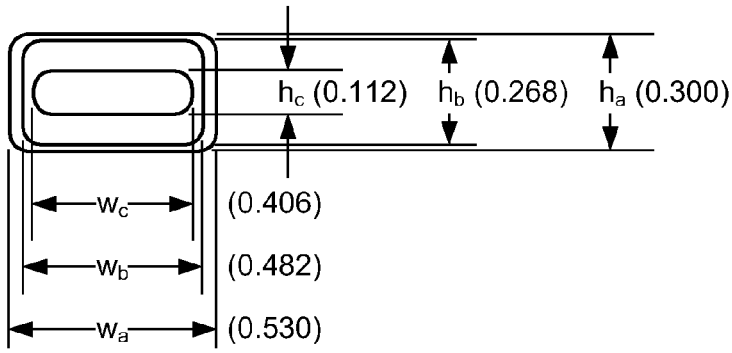
FIG. 3B is a detail from FIG. 3A showing the dimensions of a waveguide.

FIG. 3B is a detail from FIG. 3A showing the cross-sectional dimensions of the three segments a, b, c of the horizontal waveguide 144. Since the cross-sectional areas of the three segments a, b, c of the horizontal waveguide 144 decrease in order without any hidden or undercut surfaces, the horizontal waveguide 144 may be inexpensively formed by machining with an end mill or other machining process.

FIG. 4 is another side view of the exemplary OMT 100 normal to the plane of the vertical port face 152. Looking into the vertical waveguide 154, two segments f, g having differing cross-sectional areas can be seen. Segment f, having the largest cross sectional area, opens to the vertical port face 152. Segment g, having the smaller cross-sectional area, opens to the annular waveguide 125 (not visible). The section line B-B defines a plane containing the axis of the annular waveguide 125 and the axis of the vertical waveguide 154. A cross-sectional view of this plane will be shown in FIG. 6.

The two segments f, g of the vertical waveguide 154 may function as matching sections to couple the vertically polarized $TE_{11}$ mode from the annular waveguide 125 (not visible), while simultaneously rejecting the horizontally polarized $TE_{11}$ mode.

The cross-sectional shapes and lengths of the two segments f, g of the vertical waveguide 154 may be designed to minimize the return loss for a vertically polarized mode introduced via a standard waveguide (not shown) attached to the vertical port face 152. The cross-sectional shape of segment f of the vertical waveguide 154 may define a vertical port aperture in the vertical port face 152. The cross-sectional shape of the vertical port aperture may be different from, and not coaxial with, the cross-sectional shape of the standard waveguide (not shown) to be attached to the vertical port face 152. The transition from the cross-sectional shape of the vertical port aperture and the cross-sectional shape of the attached standard waveguide may contribute to the matching function described in the prior paragraph.

Figure 4A:
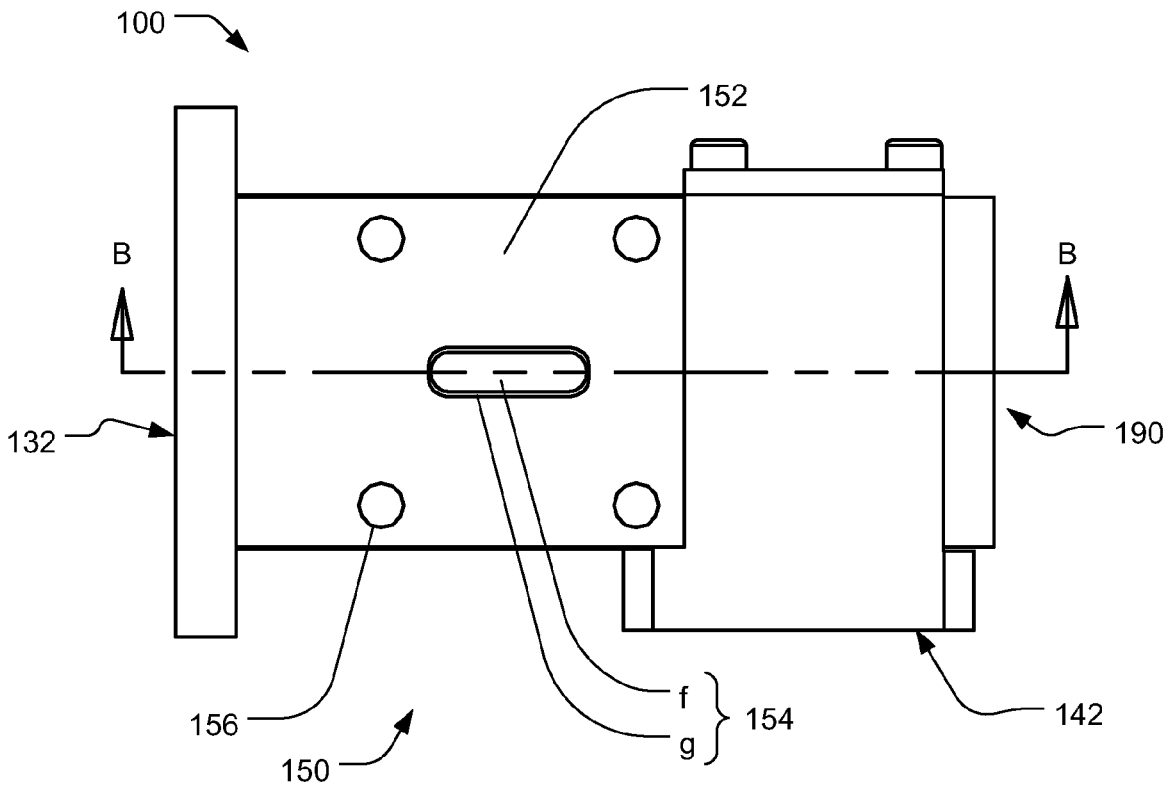
FIG. 4A is another side view of the exemplary OMT.
Figure 4B:
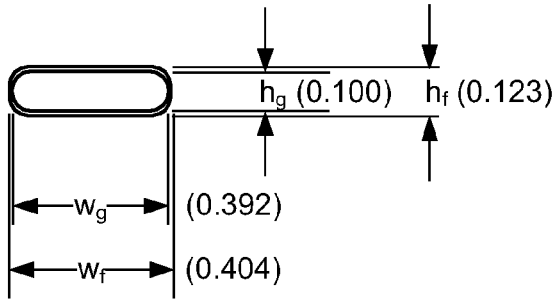
FIG. 4B is a detail from FIG. 4A showing the dimensions of another waveguide.

FIG. 4B is a detail from FIG. 4A showing the cross-sectional dimensions of the two segments f, g of the vertical waveguide 154. Since the cross-sectional areas of the two segments f, g of the vertical waveguide 154 decrease in order without any hidden or undercut surfaces, the vertical waveguide 154 may be inexpensively formed by machining with an end mill or other machining process.

Figure 5:
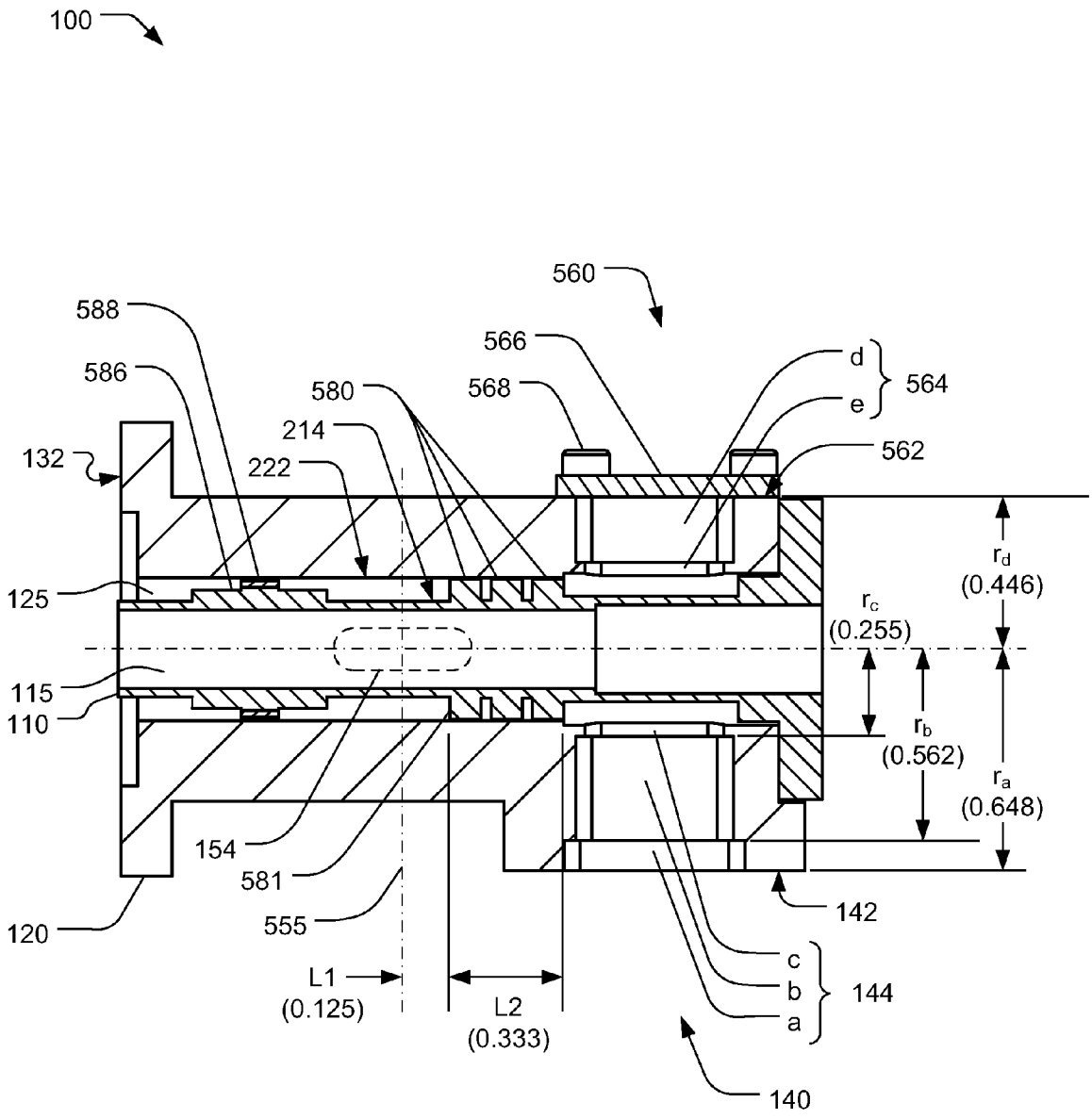
FIG. 5 is a cross-sectional view through the axis of the exemplary OMT.

FIG. 5 is a cross-sectional view of the OMT 100 at plane A-A, which was defined in FIG. 3. The lengths of the three segments a, b, c of the horizontal waveguide 144 (as defined by radial distances $r_a$, $r_b$, $r_c$) may be selected to transform the impedance of the annular waveguide 125 to the impedance of a waveguide component (not shown) that may be attached to the horizontal port face 142.

A horizontal symmetry cavity 560 may be diametrically opposed to the horizontal port 140. The horizontal symmetry cavity may include a horizontal symmetry waveguide 564. The horizontal symmetry waveguide 564 may include two segments d, e. The horizontal symmetry waveguide 564 may be, for the extent of its length (defined by radial distance $r_d$), a mirror-image of the horizontal waveguide 144. The horizontal symmetry waveguide 564 may have two segments d, e, which may have the same cross-sectional shape as the corresponding segments b, c of the horizontal waveguide 144. The length of the two segments d, e of the horizontal symmetry waveguide 564 may be separately selected and may or may not be the same as the lengths of the corresponding segments b, c of the horizontal waveguide 144. The horizontal symmetry waveguide may end at a horizontal symmetry cavity face 562. A first shorting plate 566 may be affixed to the horizontal symmetry cavity face 562 to close the end of the horizontal symmetry waveguide 564. The first shorting plate may be affixed by screws 568 or other fasteners, or by welding, soldering, conductive adhesive, or other attachment method or device.

The horizontal symmetry cavity 560 may be useful for the matching of both the horizontal and vertical ports and improving the isolation of the ports. For the horizontal port, the symmetry cavity 560 may act as a shorted stub whose length can be adjusted to help the coupling of the horizontal $TE_{11}$ mode in the annular waveguide to the $TE_{10}$ mode of a waveguide component (not shown) that may be attached to the horizontal port face 142. To the vertical $TE_{11}$ mode in the annular waveguide, the horizontal symmetry waveguide 564 and the horizontal waveguide 144 may look like identical cut-off waveguide stubs symmetrically placed on the common waveguide. To the vertical $TE_{11}$ mode, the junction of waveguides 564 and 144 may seem to have two planes of symmetry. This symmetry may prevent half of the higher order modes from being generated when the mode is scattered by the junction.

Figure 7:
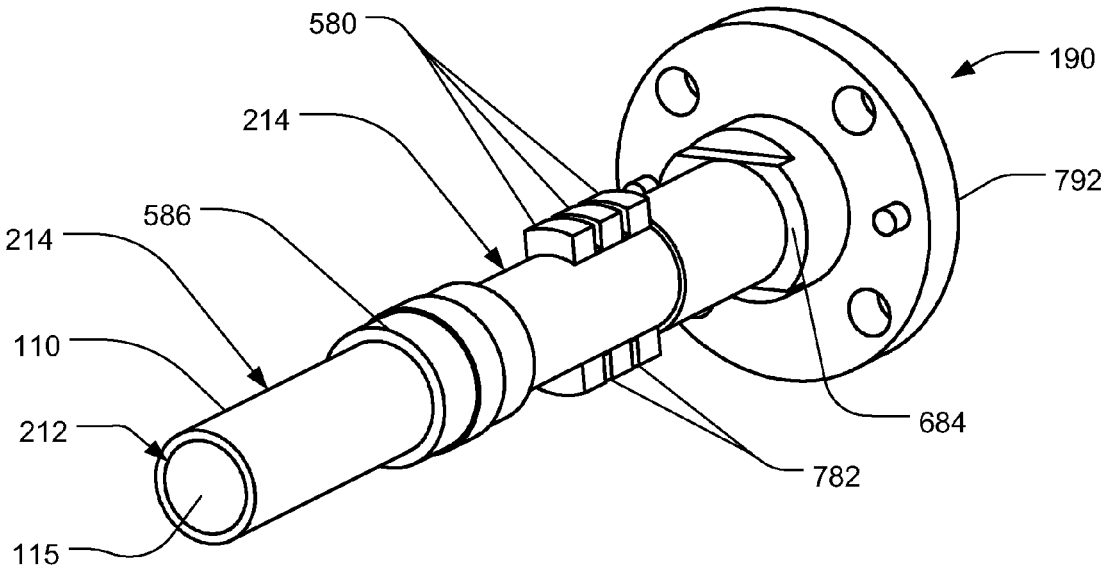
FIG. 7 is a perspective view of the inner conductor of the exemplary OMT.

A vertical back short 580 may be disposed on the inner conductor 110 between the horizontal waveguide 144 and the vertical waveguide 154. Referring to FIG. 7, which shows a perspective view of the inner conductor 110, the vertical back short can be seen to be a pair of diametrically opposed fins extending from the outer surface 214 of the inner conductor 110. The two fins of the vertical back short 580 may be divided into segments by one or more slots 782. The number and location of the slots 782 may be selected to suppress resonances within an operating frequency band of the OMT 100.

Referring again to FIG. 5, the vertical back short 580 may be disposed on the inner conductor 110 such that a distance L1 exists from an edge 581 of the vertical back short 580 to the axis 555 of the vertical waveguide 154. The distance L1 and a length L2 of the vertical back short 580 may be selected to minimize return loss for the vertical and horizontal ports and to maximize isolation between the vertical and horizontal ports. The two fins of the vertical back short 580 may extend close to but may not contact the inner surface 222 of the outer conductor 120. Not requiring electrical contact between the two fins of the vertical back short 580 and the outer conductor 120 may reduce the cost of the OMT 100 by avoiding a soldering process or other assembly process (which may have been necessary to ensure electrical contact between the fins and the outer conductor).

A first horizontal back short 584 may be disposed on the inner conductor 110 adjacent to the horizontal waveguide 144. Referring to FIG. 7, the first horizontal back short 584 can be seen to extend from a circular port flange 792 at the end of the inner conductor 110.

Referring again to FIG. 5, the first horizontal back short 584 may be disposed on the inner conductor 110. A distance L3, from the first horizontal back short 584 to the axis 545 of the horizontal waveguide 144, may be selected to minimize return loss for the vertical and horizontal ports and to maximize isolation between the vertical and horizontal ports.

Still referring to FIG. 5, the inner conductor 110 may support a dielectric spacer ring 588 which may maintain the concentricity of the annular waveguide 125. The presence of the dielectric spacer ring 588 may result in an impedance change. The inner conductor 110 may have a region 586 of increased diameter to both sides of the dielectric ring 588 to provide impedance matching.

Figure 6:
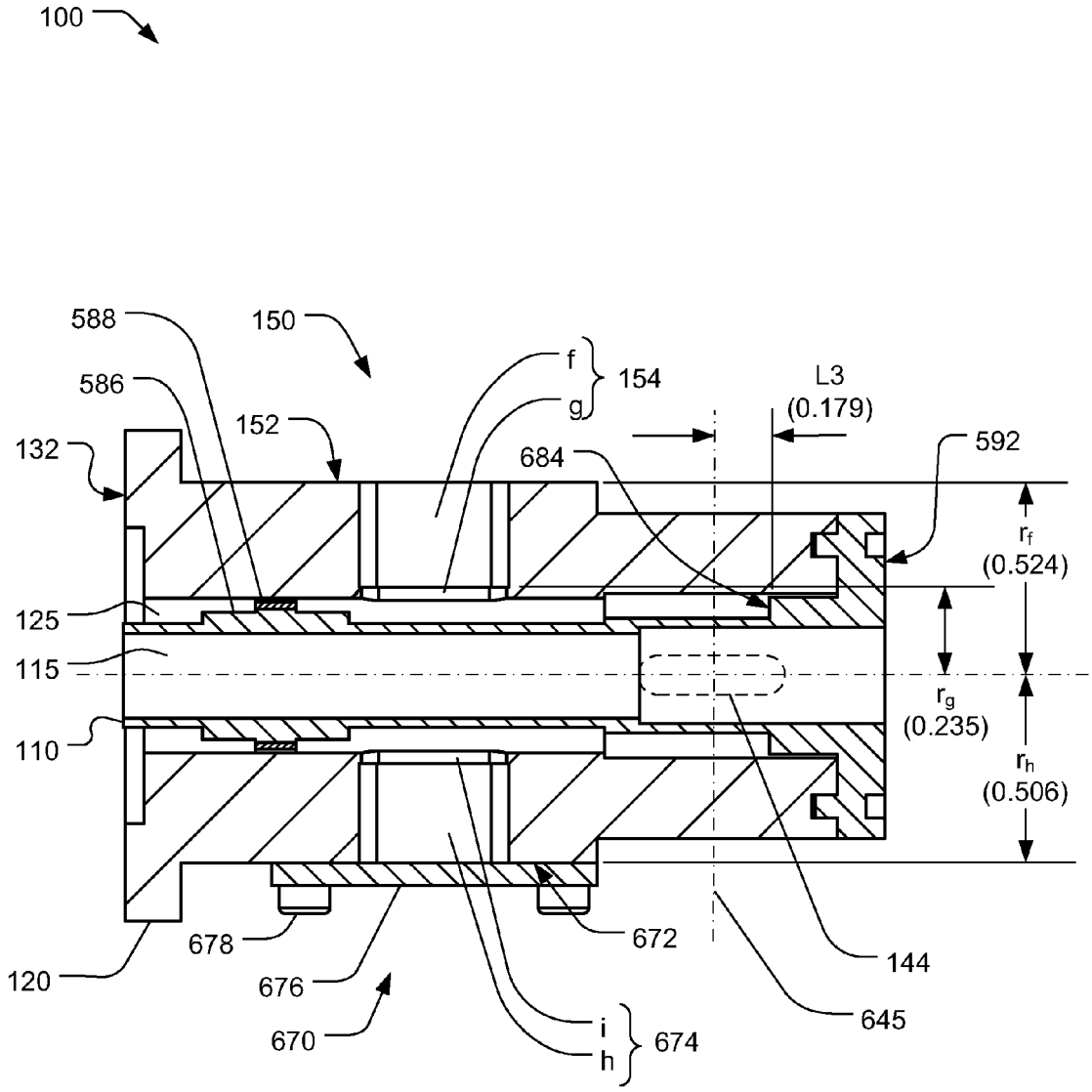
FIG. 6 is another cross-sectional view through the axis of the exemplary OMT.

FIG. 6 is a cross-sectional view of the OMT 100 at plane B-B, which is defined in FIG. 4. Plane B-B contains the axis of the annular waveguide 125 and the axis of the vertical waveguide 154.

The lengths of the two segments f, g of the vertical waveguide 154 (as defined by radial distances $r_f$ and $r_g$) may be designed to transform the impedance of the annular waveguide 125 to the impedance of the waveguide component (not shown) that may be attached to the vertical port face 152.

A vertical symmetry cavity 670 may be diametrically opposed to the vertical port 150. The vertical symmetry cavity 670 may include a vertical symmetry waveguide 674. The vertical symmetry waveguide 674 may be a mirror-image of the vertical waveguide 154. The vertical symmetry waveguide 674 may have two segments h, i, which may have the same cross-sectional shape as the corresponding segments f, g of the vertical waveguide 154. The length of the segments h, i of the vertical symmetry waveguide (as defined by radial distance $r_h$) may be separately selected and may or may not be the same as the lengths of the corresponding segments f, g of the vertical waveguide 154. The vertical symmetry waveguide 674 may end at a vertical symmetry cavity face 672. A second shorting plate 676 may be affixed to the vertical symmetry cavity face 672 to close the end of the vertical symmetry waveguide 674. The second shorting plate 676 may be affixed by screws 678 or other fasteners, or by welding, soldering, conductive adhesive, or other attachment method or device.

The vertical symmetry cavity 670 may be useful for the matching of both the horizontal and vertical ports and improving the isolation of the ports. For the vertical port, the symmetry cavity 670 may act as a shorted stub whose length can be adjusted to help the coupling of the vertical $TE_{11}$ mode in the annular waveguide to the $TE_{10}$ mode of a waveguide component (not shown) that may be attached to the vertical port face 152. To the horizontal $TE_{11}$ mode in the annular waveguide, the vertical symmetry waveguide 674 and the vertical waveguide 154 may look like identical cut-off waveguide stubs symmetrically placed on the common waveguide. To the horizontal $TE_{11}$ mode, the junction of waveguides 674 and 154 may seem to have two planes of symmetry. This symmetry may prevent half of the higher order modes from being generated when the mode is scattered by the junction.

A second horizontal back short 686 may be disposed on the inner conductor 110 adjacent to the horizontal waveguide 144. Referring to FIG. 7, the second horizontal back short can be seen to extend from a circular port flange 792 at the end of the inner conductor 110.

Referring again to FIG. 6, the second horizontal back short 686 may be disposed on the inner conductor 110. A distance L4, from the second horizontal back short 686 to the axis 545 of the horizontal waveguide 144, may be selected to minimize return loss for the vertical and horizontal ports and to maximize isolation between the vertical and horizontal ports.

Each of the inner conductor 110 and the outer conductor 120 may be formed from a solid block of an electrically conductive metal material such as aluminum, aluminum alloy, or copper. Each of the inner conductor 110 and the outer conductor 120 may be formed from a solid block of dielectric material, such as a plastic, which may then be coated with a conductive material, such as a metal film, after the machining operations were completed. If justified by the production quantity, a blank approximating the shape of the inner conductor 110 and/or the outer conductor 120 could be formed prior the machining operations. The blank could be either metal or dielectric material and could be formed by a process such as casting or injection molding. Each of the inner conductor 110 and the outer conductor 120 may also be formed by assembling a plurality of components using screws or other fasteners, welding, soldering, adhesive bonding, or some other assembly technique.

The dielectric spacer ring 588 may be fabricated from a low-loss polystyrene plastic material such as Rexolite (available from C-LEC Plastics) or another dielectric material suitable for use at the frequency of operation of the OMT 100.

An OMT, such as the OMT 100, may be designed by using a commercial software package such as CST Microwave Studio. An initial model of the OMT may be generated with initial waveguide dimensions and relative positions that allow two orthogonal $TE_{11}$ modes to be supported in the annular common waveguide 125, and that allow the horizontal and vertical branching waveguides to each support a single $TE_{10}$ mode, all over the desired operating frequency band. The structure may then be analyzed, and the reflection coefficients and isolation of the three ports may be determined. The dimensions of the model may be iterated and optimized manually or automatically to minimize the reflection coefficients and maximize the isolation of the dominant modes at each of the three ports.

Dimensions that may be manually or automatically optimized to minimize reflection coefficients and maximize isolation include the annular waveguide inner and outer diameters (Di, Do), the dimensions of the horizontal waveguide ($w_a$, $h_a$, $r_a$, $w_b$, $h_b$, $r_b$, $w_c$, $h_c$, $r_c$), the length ($r_d$) and other dimensions of the horizontal symmetry waveguide, the dimensions of the vertical waveguide ($w_f$, $h_f$, $r_f$, $w_g$, $h_g$, $r_g$), the length ($r_h$) of the vertical symmetry waveguide, the dimensions (L1, L2, L3, L4) of the horizontal and vertical back shorts, and other dimensions. The dimensions of the specific embodiment given in FIGS. 2, 3B, 4B, 5, and 6 may be suitable, if scaled, as the initial dimensions for the design of OMTs for other frequency bands or applications.

Figure 8:
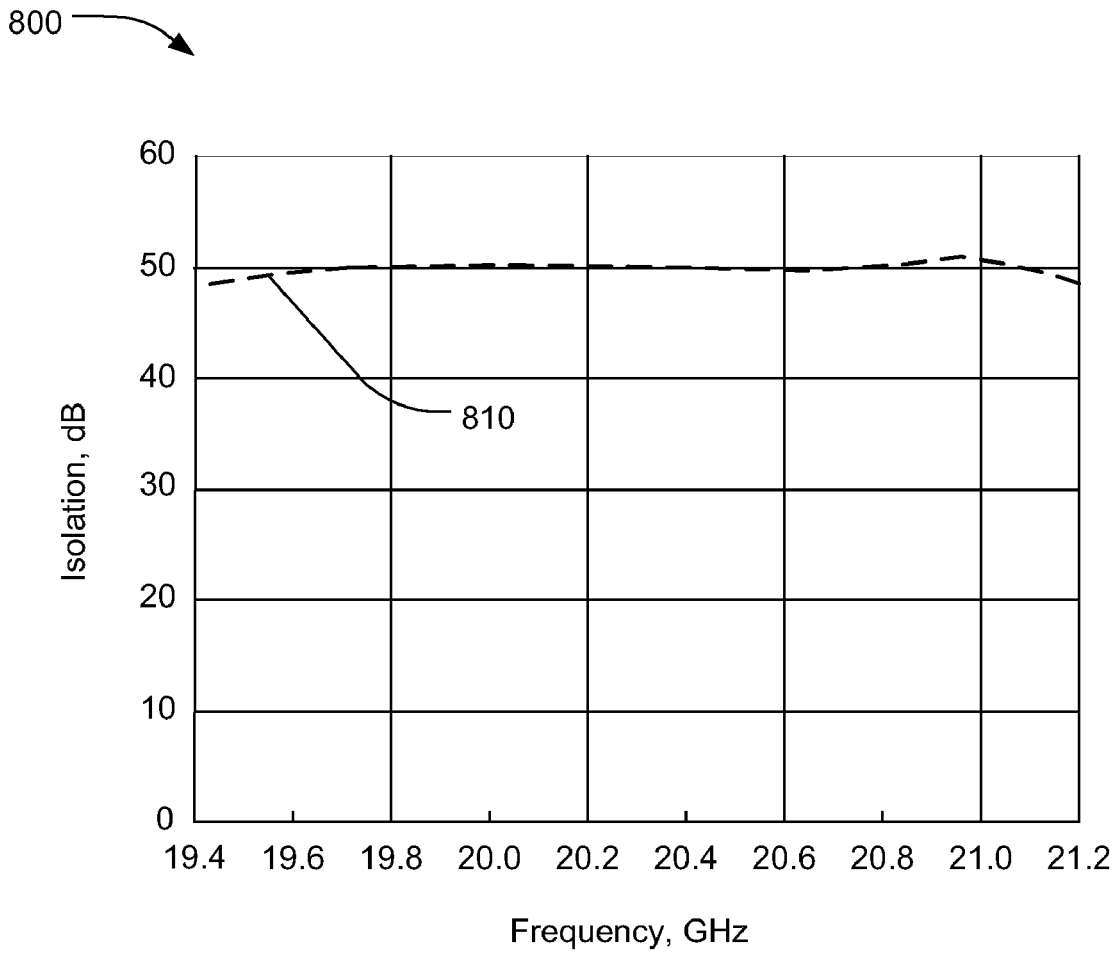
FIG. 8 is a graph showing the simulated performance of an OMT.

FIG. 8 is a graph 800 illustrating the simulated performance of an OMT similar to the specific embodiment of the OMT 100. The dashed line 810 plots the isolation between the vertical and horizontal ports of the OMT. The isolation between the two ports may be 48 dB or greater over a frequency band from 19.4 GHz to 21.2 GHz.

Figure 9:
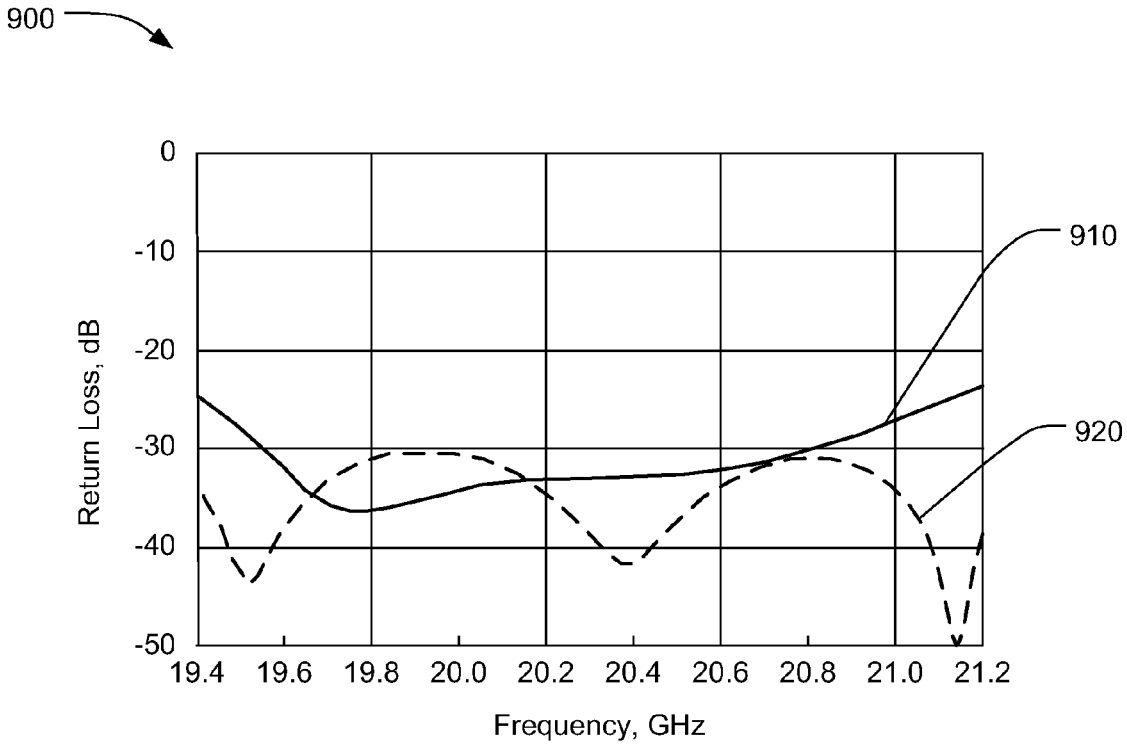
FIG. 9 is another graph showing the simulated performance of an OMT.

FIG. 9 is a graph 900 illustrating the simulated performance of an OMT similar to the specific embodiment of the OMT 100. The solid line 910 and the dashed line 920 plot the return loss of the vertical and horizontal ports of the OMT. The return loss may be less than −24 dB over a frequency band from 19.4 GHz to 21.2 GHz.

Figure 10:
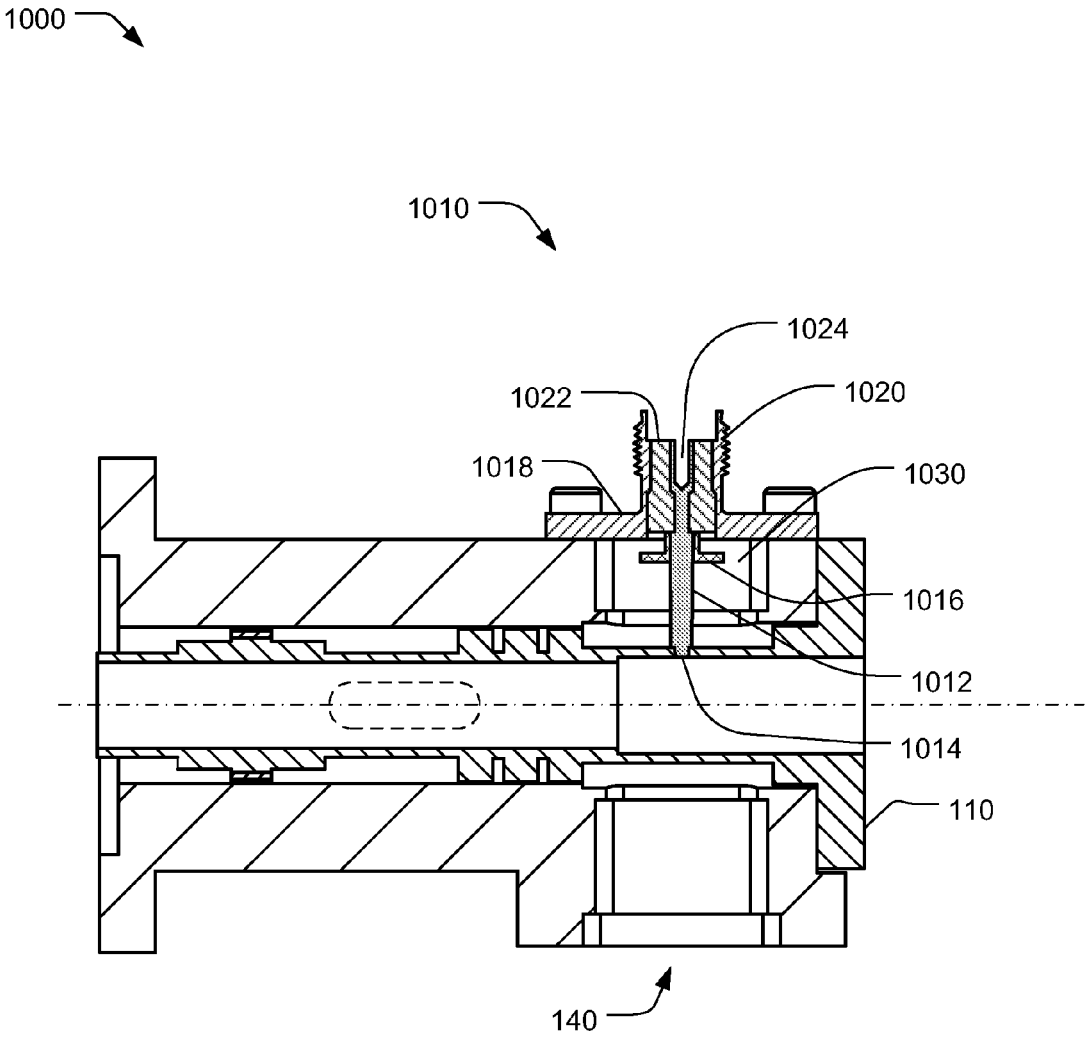
FIG. 10 is a cross-sectional view through the axis of an OMT including a TEM probe.

FIG. 10 is a cross-sectional view of an OMT 1000 at plane A-A, which was defined in FIG. 3. The OMT 1000 may be the same as the OMT 100 in most aspects, with the addition of a TEM probe 1010. Features visible but not identified in FIG. 10 are the same as the corresponding features in FIG. 5.

The TEM probe 1010 may be incorporated into the OMT 1000 to suppress resonance of a TEM mode in the coaxial waveguide. TEM resonance within the operating bandwidth of an OMT device, if not suppressed, may cause undesired abrupt changes in the performance of the OMT. The TEM probe may couple TEM energy present in the coaxial waveguide to a termination external to the coaxial waveguide and thus prevent resonance. The performance of the OMT 1000 with the TEM probe 1010 may be similar to the performance shown in FIG. 8 and FIG. 9.

The TEM probe 1010 may include an elongate conductive pin 1012 that extends into a horizontal symmetry cavity 1030 opposed to the horizontal port 140. The horizontal symmetry cavity 1030 may be similar in location and function to the horizontal symmetrical cavity 560 of FIG. 5. The horizontal symmetry cavity 1030 may have slightly different shape and dimensions that the horizontal symmetry cavity 560 to account for the presence of the conductive pin 1012.

The elongate conductive pin 1012 may have a first end 1014 and a second end 1024. The first end 1014 may contact the inner conductor 110 of the coaxial waveguide. For example, as shown in FIG. 10, the first end 1014 of the conductive pin 1012 may thread into a mating threaded hole in the inner conductor 110. The second end 1024 of the conductive pin 1012 may function as the center contact of a coaxial connector to allow convenient connection of a standard termination (not shown) to absorb TEM energy coupled through the conductive pin 1012. For example, the second end of the elongate conductive pin may include a socket, as shown in FIG. 10, to serve as a female contact of the coaxial connector.

A dielectric load 1016 may be disposed on the conductive pin 1012 to provide impedance matching between the symmetry cavity 1030 and the coaxial connector. The dielectric load may be a stepped ring as shown in FIG. 10, or some other impedance matching structure.

In the example of FIG. 10, the second end 1024 of the conductive pin 1012 is incorporated into an SMA (subminiature type A) connector. A base 1018 includes a barrel 1020 that servers as the outer contact of the SMA connector. The barrel may have inner and outer cylindrical surfaces concentric with the elongate conductive pin 1012. The outer cylindrical surface of the barrel 1020 may be threaded as shown. The base 1018 may also serve as a shorting plate to close the horizontal symmetry cavity 1030. A spacer 1022 may be disposed between the threaded barrel 1020 and the conductive pin 1012. The spacer may be fabricated from PTFE (polytetrafluoroethylene) consistent with the typical construction of an SMA connector. A standard 50-ohm SMA termination (not shown) may be connected to the SMA connector to absorb TEM energy coupled through the conductive pin 1012.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

The invention claimed is:

1. An ortho-mode transducer (OMT), comprising:

an annular common waveguide defined by an outer surface of an inner conductor and an inner surface of an outer conductor, the outer surface and the inner surface concentric about a waveguide axis a first port for coupling a first $TE_{11}$ mode to the annular common waveguide a second port for coupling a second $TE_{11}$ mode to the annular common waveguide, the second $TE_{11}$ mode orthogonal to the first $TE_{11}$ mode a TEM probe configured to suppress resonance of a TEM mode within the annular common waveguide, the TEM probe configured to couple TEM energy from the annular common waveguide to a connector external to the annular common waveguide.

2. The OMT of claim 1, further comprising:

a first symmetry cavity diametrically opposed to the first port wherein the TEM probe extends into the first symmetry cavity.

3. The OMT of claim 2, wherein the TEM probe comprises an elongate conductive pin having a first end in contact with the inner conductor and a second end disposed as a center conductor of a coaxial connector.

4. The OMT of claim 3, wherein the coaxial connector further comprises:

a base disposed to terminate the first symmetry cavity a cylindrical barrel extending from the base, the barrel having inner and outer cylindrical surfaces concentric with the conductive pin a dielectric spacer disposed between the inner surface of the barrel and the conductive pin.

5. The OMT of claim 4, wherein the outer surface of the barrel is threaded to accept an SMA (subminiature type A) termination to absorb TEM energy coupled through the conductive pin.

6. The OMT of claim 3, the TEM probe further comprising a dielectric load disposed on a portion of the conductive pin to provide impedance matching between the symmetry cavity and the coaxial connector.

7. The OMT of claim 1, further comprising:

a first back-short adjacent to the first port a second back-short disposed on the outer surface of the inner conductor between the first port and the second port.

8. The OMT of claim 7, wherein the second back-short comprises two diametrically opposed fins extending from the outer surface of the inner conductor.

9. The OMT of claim 8, wherein the two diametrically opposed fins are symmetrical about a plane passing through the waveguide axis parallel to a polarization plane of the second $TE_{11}$ mode coupled by the second port.

10. The OMT of claim 7, wherein the first back-short extends from a circular port flange that closes an annular space between the outer surface of the inner conductor and the inner surface of the outer conductor.

11. The OMT of claim 1, wherein the first port is coupled to the annular common waveguide by a first generally rectangular waveguide having a first plurality of segments configured to be fabricated by machining with an end mill without undercuts or hidden surfaces.

12. The OMT of claim 1, wherein the second port is coupled to the annular common waveguide by a second generally rectangular waveguide having a second plurality of segments configured to be fabricated by machining with an end mill without undercuts or hidden surfaces.

13. The OMT of claim 2, further comprising:

a second symmetry cavity diametrically opposed to the second port.

14. An ortho-mode transducer (OMT), comprising:

an annular common waveguide defined by an outer surface of an inner conductor and an inner surface of an outer conductor, the outer surface and the inner surface concentric about a waveguide axis a first port for coupling a first $TE_{11}$ mode to the annular common waveguide, the first port coupled to the annular common waveguide by a first generally rectangular waveguide having a first plurality of segments configured to be fabricated by machining with an end mill without undercuts or hidden surfaces a second port for coupling a second $TE_{11}$ mode to the annular common waveguide, the second $TE_{11}$ mode orthogonal to the first $TE_{11}$ mode a TEM probe configured to suppress resonance of a TEM mode within the annular common waveguide.

15. An ortho-mode transducer (OMT), comprising:

an annular common waveguide defined by an outer surface of an inner conductor and an inner surface of an outer conductor, the outer surface and the inner surface concentric about a waveguide axis a first port for coupling a first $TE_{11}$ mode to the annular common waveguide a first symmetry cavity diametrically opposed to the first port a second port for coupling a second $TE_{11}$ mode to the annular common waveguide, the second $TE_{11}$ mode orthogonal to the first $TE_{11}$ mode a second symmetry cavity diametrically opposed to the second port a TEM probe configured to suppress resonance of a TEM mode within the annular common waveguide, wherein the TEM probe extends into the first symmetry cavity.

* * * * *